US005901422A

United States Patent [19]

White et al.

[11] Patent Number: 5,901,422

[45] Date of Patent: May 11, 1999

[54] ENDLESS LOOP FINISHING ASSEMBLY

[75] Inventors: James S. White, Shaftsbury, Vt.; Edward C. Kirchner, Pittsfield, Mass.

[73] Assignee: Morrison Berkshire, Inc., North Adams, Mass.

[21] Appl. No.: 08/924,170

[22] Filed: Sep. 5, 1997

[51] Int. Cl.[6] ..... D06C 3/06

[52] U.S. Cl. ..... 26/71; 26/1; 26/106; 28/142

[58] Field of Search ..... 26/1, 51, 71, 80, 26/81, 83, 99, 106; 28/142; 162/272, 273, 274

[56] References Cited

U.S. PATENT DOCUMENTS

| | | | |
|---|---|---|---|
| 2,950,224 | 8/1960 | Balough . | |
| 3,149,003 | 9/1964 | Christie et al. . | |
| 3,547,776 | 12/1970 | Curtis . | |
| 3,596,372 | 8/1971 | Hundseld | 26/106 |
| 3,617,444 | 11/1971 | Hundseld | 162/275 |
| 3,940,833 | 3/1976 | Troope et al. | 26/18.6 |
| 4,232,435 | 11/1980 | Eriksen | 26/106 |
| 4,256,537 | 3/1981 | Stanislaw | 28/142 |
| 4,400,238 | 8/1983 | Stanislaw et al. | 26/106 |
| 4,495,714 | 1/1985 | Eriksen | 28/142 |
| 4,504,359 | 3/1985 | Eriksen | 162/274 |
| 5,005,272 | 4/1991 | Severinsen | 26/106 |
| 5,312,523 | 5/1994 | Eriksen et al. | 162/274 |
| 5,357,661 | 10/1994 | Eriksen et al. | 26/51 |
| 5,427,653 | 6/1995 | Andersson et al. | 162/199 |

*Primary Examiner*—Amy Vanatta

*Attorney, Agent, or Firm*—Lerner, David, Littenberg, Krumholz & Mentlik, LLP

[57] ABSTRACT

A finishing assembly which includes an outside treatment roll for treating both sides of an endless web without having to remove, turn inside out and reload the endless web onto the finishing assembly. The outside treatment roll is movable and adapted to contact the endless web within an opening defined between a pair of cantilever beams such that the "minimum loop length" of the endless web is preserved. The finishing assembly includes a movable non-contacting treatment assembly which is adapted to be arranged between the cantilever beams such that the non-contacting treatment assembly may be used with or without the outside treatment roll to facilitate different finishing processes.

55 Claims, 10 Drawing Sheets

ENDLESS LOOP FINISHING ASSEMBLY

FIELD OF THE INVENTION

The present invention relates to a finishing assembly for treating an endless loop or web which may be used in a paper making assembly and in particular to an endless web finishing assembly which provides for treatment of both surfaces of the endless web while the endless web remains loaded on the finishing assembly.

BACKGROUND OF THE INVENTION

Paper is produced on paper making assemblies consisting of several paper processing machines. Each of these machines utilizes endless loops or webs (e.g., fabric or felt endless webs). Generally, a paper making assembly includes at least a forming stage, a press stage, a dryer stage and a winding and cutting stage. As part of paper making processes, in general, a slurry pulp mixture is disposed onto a first endless web, i.e., the forming stage felt or web. Most of the water contained in the slurry mixture is removed at this stage at which time the paper begins to take form. That is, the surface of the paper mixture itself begins to reflect the web on which it lies during this initial stage of the process.

This paper forming mixture then moves to a second stage, i.e., the press stage, which employs a second endless web. At this stage, as most of the remaining amount of water has been removed, the paper mixture begins to possess characteristics of finished paper. Here, too, the paper surface being formed is reflective of the surface of the web on which it lies.

Thus, it is desirable for the webs in at least these initial two stages to be as smooth as possible and devoid of any imperfections or variations so that the paper which is formed thereupon likewise will be smooth and uniform. In this regard, the webs should be endless, instead of being pieces sewn together to make a loop, to eliminate any seams either in the machine direction (i.e., the longitudinal direction in which the endless web rotates, or in the cross machine direction, i.e., the direction perpendicular or transverse to the machine direction. Such a seam would create imperfections, or at least variations in the paper, both of which are unacceptable for paper making assemblies.

Typically, the endless webs also are treated with non-contacting methods such as chemicals, mechanical and radiant energy, or by stretching or other similar methods to achieve a smooth set surface. This setting of the endless webs also must be performed in a consistent manner so as to avoid certain imperfections.

Since the webs are endless, the finishing assemblies used to treat them will usually govern their overall loop length or circumferential length. This is commonly referred to as the "minimum loop length." Certain types of endless web finishing assemblies may include at least one inside treatment roll which heats the endless web on contact, at least one inside treatment roll which stretches the endless web, and possibly a non-contacting treatment device such as an air box (or oven) which treats the endless web without contacting it. Also, since the webs or loops are endless, the rolls and/or ovens have to be manipulated and moved so that the endless web can be loaded onto the finishing assembly and off-loaded from the finishing assembly without interference with the rolls and/or ovens and without damaging the endless web.

These endless webs are fairly large and cumbersome and it is uneconomical in terms of production time and labor costs to remove the endless webs during a treatment session.

There also is always the risk of potentially damaging the web when it is being removed and turned. These webs are extremely expensive and may have to be scrapped if enough damage is incurred when unloading and turning them. Thus, it is desirable in the felt making industry to treat both the outside and inside surfaces of the endless web without having to remove or unload the endless web, flip it inside out and reload it onto the finishing assembly again. Collectively, the manipulation of the web is commonly called "felt turning." One way to avoid this felt turning step is to employ an outside treatment device. There is a competing need to keep certain webs as small as possible. This is further discussed below.

Certain of these finishing assemblies include cantilevered supports for supporting one or both of the inside treatment rolls while the endless web is being loaded and unloaded. In these assemblies, the outside treatment device is usually positioned between the outside of a cantilevered support and one of the inside treatment rolls. This is so because an air box or oven set will typically be attached to the cantilevered support on the inside.

In the paper making process discussed above, it is desirable to have at least one very short endless web having the shortest "minimum loop length" possible. This web is usually utilized for the first stage, i.e., the forming stage. It also is desirable to treat other endless webs at varying sizes to accommodate the various other stages of the paper making processes as mentioned above. Thus, it is desirable to have an endless web finishing assembly which is capable of accommodating the smallest "minimum loop length" as well as at the same time being versatile to accommodate a variety of endless web lengths and treatment processes.

However, with the introduction of an outside treatment device, as discussed above and as generally found in the prior art, the "minimum loop length" would be increased by at least the diameter or width of the outside treatment roll since this device is usually placed between one of the inside rolls and adjacent or outside of the cantilevered support to allow room for the air boxes or ovens. Hence, the overall "minimum loop length" is dictated by the total diameters of the inside treatment rolls, the diameter or width of the outside treatment device and the width of the air box set, in addition to the amount of wrap (or that portion of the endless web which contacts the rolls).

Assemblies for treating both the outside and inside of an endless web without felt turning are known. But in most of these attempts, the "minimum loop length" is necessarily increased as a result of the added equipment needed to treat the outside of the web. In certain cases, in order to maintain the "minimum loop length," oven sets or other non-contacting treatment assemblies are permanently attached to a cantilevered support or at least the bottom oven is attached and the top oven is movable. However, by keeping these ovens (or at least the bottom oven) permanently attached to a cantilevered support, it considerably reduces the amount of surface area or dwell time in which an outside contact treatment device can contact the endless web. This is so because to preserve the "minimum loop length," the outside contact treatment device is brought into the same area as the ovens. As such, the outside treatment device cannot be brought up high enough to increase the treatment area (i.e., wrap or dwell time).

Also, U.S. Pat. No. 5,312,523 issued to Erickson et al., discloses a glide surface positioned between a rotatable heatable roller 2 and a rotatable roller 3. Roller 3 is movably mounted for movement toward and away from roller 2, so that it functions as a tension roller. The glide surface 4 is shown between the roller 2 and roller 3. In addition, FIG. 4 of this reference discloses a glide surface 4 and a heater box 15 where the glide surface provides only a small contact surface area. The glide surface is stationary with relation to the movement of the endless web. Thus, there is a resulting relative motion between the glide and the endless web. This relative motion may cause a less than smooth resulting web for several reasons. For instance, since the glide is stationary with respect to the moving endless web, much friction is created. This results in a greater potential for the endless web to bow or skew. This leads to undesirable surface, draining or other mechanical imperfections in the endless web. In addition, since there is a limited contact surface area with the glide, there is less tension control overall and less treatment area per linear foot.

Therefore, there is a need to have an endless web finishing assembly which preserves the shortest "minimum loop length" possible while providing for treatment of the inside and outside surfaces of the endless web, avoiding the need for felt turning. There also is a need to treat the endless web with a non-contacting treatment assembly in combination with an outside treatment device such as a treatment roll, where the non-contacting treatment assembly and the outside treatment roll treat the web during the same processing session while occupying the same general area within the finishing assembly. This results in preservation of the "minimum loop length." There is a further need to have a movable non-contacting assembly which is capable of being moved into or out of the finishing assembly to allow for different finishing processes and to provide for sufficient dwell time or wrap for such processes without the need to increase the "minimum loop length." This non-contacting treatment assembly should be able to be moved as a unit, or it may be moved into and out of operation in parts.

SUMMARY OF THE INVENTION

The present invention addresses these needs and provides for a versatile finishing assembly which is capable of being used in various types of universal treatment applications and processes which require endless webs with the smallest possible "minimum loop length" as well as endless webs requiring different loop lengths and treatment specifications.

In accordance with one aspect of the present invention, there is provided a finishing assembly for treating an endless web which extends in a machine direction when loaded onto the finishing assembly, comprising a cantilevered support having a generally horizontal free end comprising at least two cantilever beams extending in a direction generally transverse to the machine direction of the finishing assembly. The at least two cantilever beams define a transversely-extending open space therebetween. The finishing assembly further comprises first and second inside treatment rolls for contacting the inside surface of the endless web to treat the endless web. Each inside treatment roll is arranged to be supported on the cantilevered support when in an endless web loading position. At least one of the inside treatment rolls is movable between the loading position and an endless web treatment position wherein the at least one inside treatment roll is spaced apart from the cantilevered support in a direction generally parallel to the machine direction. Also included in this aspect is a movable roll carriage device for moving the at least one inside treatment roll between the loading position and the treatment position, and an outside treatment roll for contacting the outside surface of the endless web to treat the endless web. The outside treatment roll is movable between a first position and a second position. When in the first position, the outside treatment roll is positioned in the transversely-extending open space and operative to contact the outside surface of the endless web over a predetermined contact surface area, and when in the second position, it is positioned outside of the transversely-extending open space to allow for the endless web to be loaded onto the finishing assembly.

Preferably, one of the inside treatment rolls is supported on one of the at least two cantilever beams and the other of the inside treatment rolls is supported on the other of the at least two cantilever beams when the inside treatment rolls are in an endless web loading position.

Further, at least one of the inside treatment rolls of the finishing assembly is preferably heated. More preferably, the outside treatment roll is heated.

Desirably, at least one of the inside treatment rolls is a stretch roll.

In accordance with another aspect of the present invention, there is provided a finishing assembly for treating an endless web which extends in a machine direction when loaded onto the finishing assembly, comprising a cantilevered support having a generally horizontal free end comprising at least two cantilever beams extending in a direction generally transverse to the machine direction of the finishing assembly. The at least two cantilever beams define a transversely-extending open space therebetween. Also included are first and second inside treatment rolls for contacting the inside surface of the endless web to treat the endless web. Each of the inside treatment rolls is arranged to be supported on the cantilevered support when in an endless web loading position. At least one of the inside treatment rolls is movable between the loading position and an endless web treatment position, wherein the at least one inside treatment roll is spaced apart from the cantilevered support in a direction generally parallel to the machine direction. Further provided is a movable roll carriage device for moving the at least one inside treatment roll between the loading position and the treatment position. Also, this aspect includes a non-contacting treatment assembly comprising a pair of transversely-extending housings. The housings define a horizontal gap therebetween through which the endless web is movable. The non-contacting treatment assembly is movable between a treatment position and a non-treatment position. When in the treatment position, the non-contacting treatment assembly is positioned between the at least two cantilever beams such that at least one of the housings is positioned in the transversely-extending open space, and when in the non-treatment position, both of the housings are positioned outside of the transversely-extending open space.

Desirably, at least one of the housings comprises an air treatment source. Preferably, the air treatment source is heated air.

In another embodiment, at least one of the housings comprises a radiation energy source such as, for example, an infrared, microwave or ultraviolet energy source.

Preferably, the housings are supported by the cantilevered support. More preferably, one of the housings is supported by the cantilevered support and the other of the housings is supported by the one housing.

Most preferably, the non-contacting treatment assembly further comprises a hoist mechanism for moving the housings as a unit between the treatment and non-treatment positions.

In accordance with yet another aspect of the present invention, there is provided a finishing assembly for treating an endless web which extends in a machine direction when loaded onto the finishing assembly, comprising a cantilevered support having a generally horizontal free end comprising at least two cantilever beams extending in a direction generally transverse to the machine direction of the finishing assembly. The at least two cantilever beams define a transversely-extending open space therebetween. This aspect further comprises first and second inside treatment rolls for contacting the inside surface of the endless web to treat the endless web, each inside treatment roll being arranged to be supported on the cantilevered support when in an endless web loading position. At least one of the inside treatment rolls is movable between the loading position and an endless web treatment position, wherein the at least one inside treatment roll is spaced apart from the cantilevered support in a direction generally parallel to the machine direction. Also included is a movable roll carriage device for moving the at least one inside treatment roll between the loading position and the treatment position. Further, this aspect includes an outside treatment roll for contacting the outside surface of the endless web to treat the endless web. The outside treatment roll is movable between a first position and a second position. The outside treatment roll, when in the first position, is positioned in the transversely-extending open space and operative to contact the outside surface of the endless web over a predetermined contact surface area, and when in the second position is positioned outside of the transversely-extending open space to allow for the endless web to be loaded onto the finishing assembly. Also provided is a non-contacting treatment assembly comprising a pair of transversely-extending housings. The housings define a horizontal gap therebetween through which the endless web is movable. The non-contacting treatment assembly is movable between a treatment position and a non-treatment position. When in the treatment position, the non-contacting treatment assembly is positioned adjacent the at least one cantilever beam such that at least one of the housings is positioned in the transversely-extending open space, and when in the non-treatment position, both of the housings are positioned outside of the transversely-extending open space.

BRIEF DESCRIPTION OF THE DRAWINGS

The above and other features, aspects and advantages of the present invention will become apparent, as will a better understanding of the concepts underlying the present invention, by reference to the description which follows and refers to the accompanying drawings in which.

DETAILED DESCRIPTION OF THE PREFERRED EMBODIMENT

The present invention is directed to a finishing assembly for treating an endless web made of, for example, fabric or felt, where the endless web is typically intended for use in paper making assemblies. Of course, however, the endless web may be used in other types of applications such as conveyors, textile making machines or assemblies and/or conveying systems.

Figure 1:
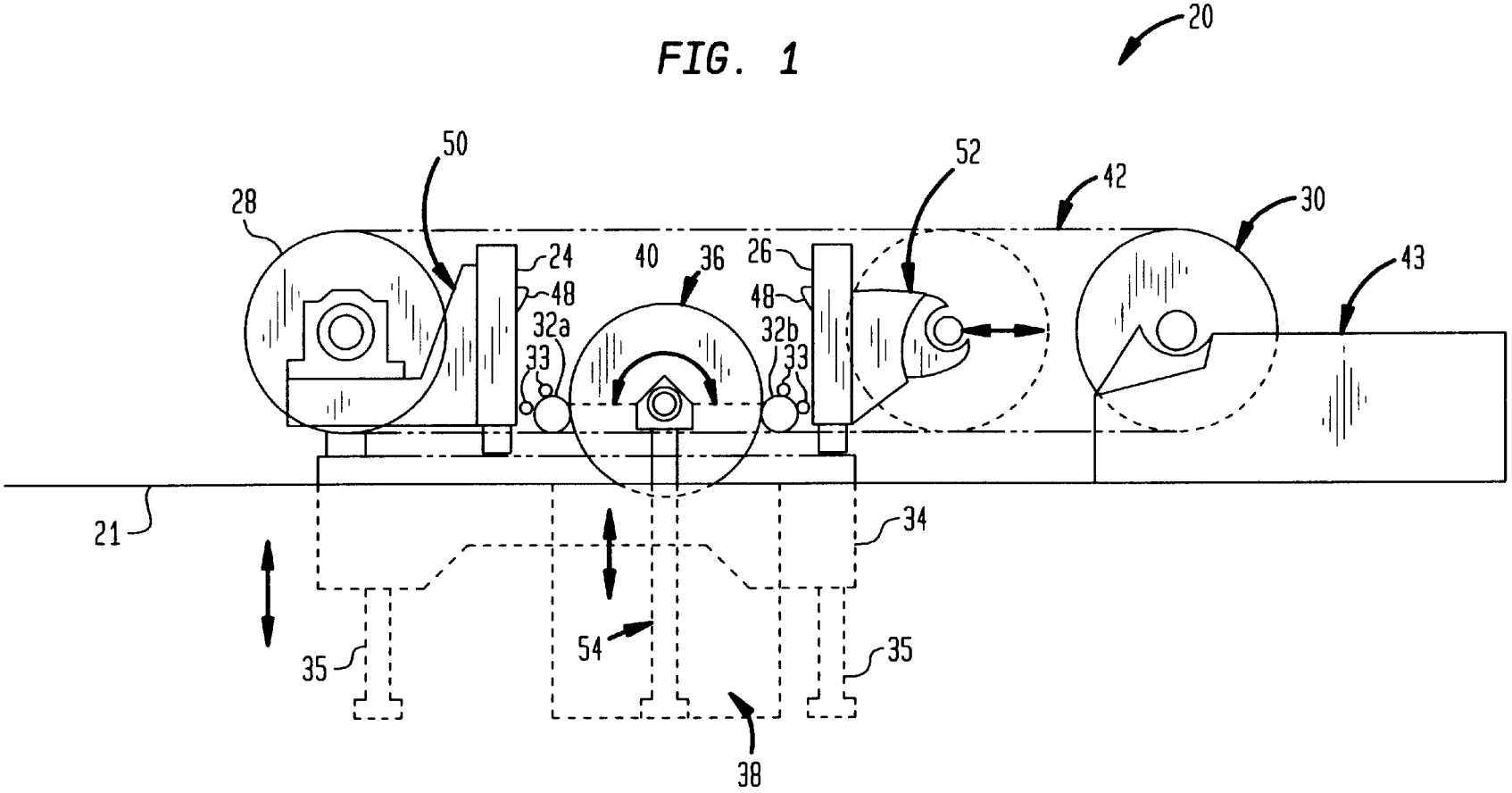
FIG. 1 is a schematic side elevation view of a finishing assembly in accordance with one embodiment of the present invention, illustrating the outside treatment roll in an operational position.

In accordance with one aspect of the present invention, as shown in FIG. 1, there is provided a finishing assembly generally designated 20. The finishing assembly 20 comprises a cantilevered support 22 (not shown in FIG. 1) (see FIGS. 2A to 5 for other variations of the cantilevered support; namely, cantilevered supports 122, 222 and 322), comprised of a pair of cantilever beams 24 and 26, for supporting a first inside treatment roll 28, a second inside treatment roll 30 and a pair of felt guide or felt follower rolls 32*a* and 32*b*. Also shown in the finishing assembly 20 is a drop frame 34, an outside treatment roll 36 and a recessed open space 38. In addition, the finishing assembly 20 discloses an endless loop or web 42. The endless web 42 is shown loaded onto the finishing assembly 20 and in position for treatment. Finally, the finishing assembly 20 includes a movable roll carriage device 43 for moving the inside treatment roll 30 toward and away from the cantilevered support 22.

Figure 2A:
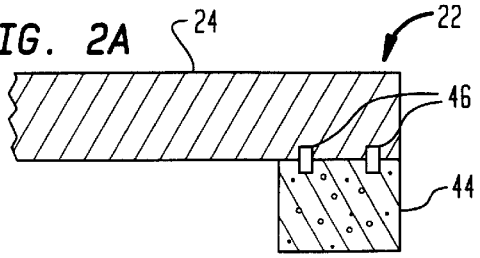
FIG. 2A is a schematic side elevation view of one embodiment of a cantilever beam for use in the cantilevered support of the finishing assembly of FIG. 1.
Figure 2B:
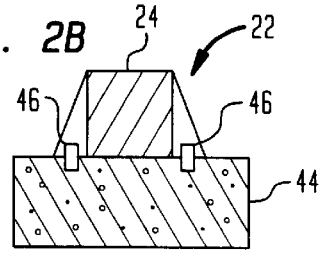
FIG. 2B is a schematic rear elevation view of the cantilever beam of FIG. 2A.
Figure 3A:
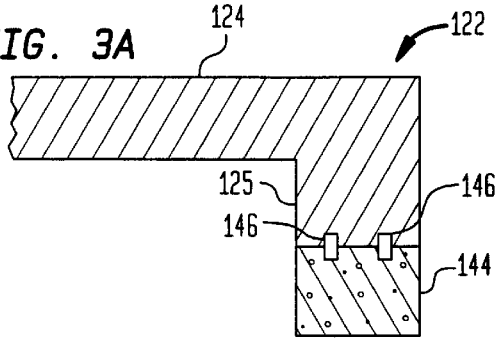
FIG. 3A is a schematic side elevation view of another embodiment of a cantilever beam for use in the cantilevered support of the finishing assembly of FIG. 1.
Figure 3B:
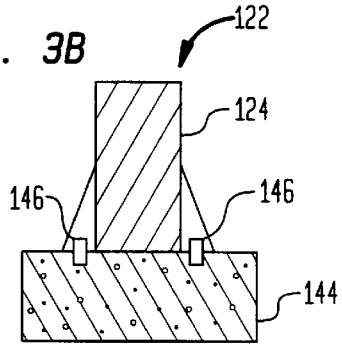
FIG. 3B is a schematic rear view of the cantilever beam of FIG. 3A.

The cantilever beams 24 and 26 define a transversely-extending open space 40 for partially receiving the outside treatment roll 36 and/or a non-contacting treatment assembly (as described below). Several different types of cantilever beams may be used which are within the scope of the present invention. For example, as shown in FIGS. 2A and 2B, there is a cantilevered support 22 including cantilever beam 24. Cantilever beam 24 is attached to a cantilever foundation 44 by fasteners such as bolts 46 or alternatively by other types of fasteners such as concrete anchors or screws and the like. In this particular cantilevered support 22, the cantilever beam 24 may be constructed of any suitable material which is capable of withstanding the loads typically placed upon these beams in machine assemblies such as the ones described herein. Preferably such cantilever beam material may consist of, by way of example, metal such as steel or any other type of suitable material such as composite material and the like. The cantilever foundation 44 may be made of a concrete or concrete-like material, and preferably reinforced concrete. FIGS. 3A and 3B show a variation of the cantilevered support 22 as shown in FIGS. 2A and 2B. In this version, the cantilever beam 124 includes a vertical portion 125. Otherwise, the mechanics of, and materials used to manufacture, these two versions are similar. For instance, in these two versions of a cantilevered support, the cantilever foundations 44 and 144 take a substantial portion of the load carried by the beams instead of the beams themselves.

Figure 4A:
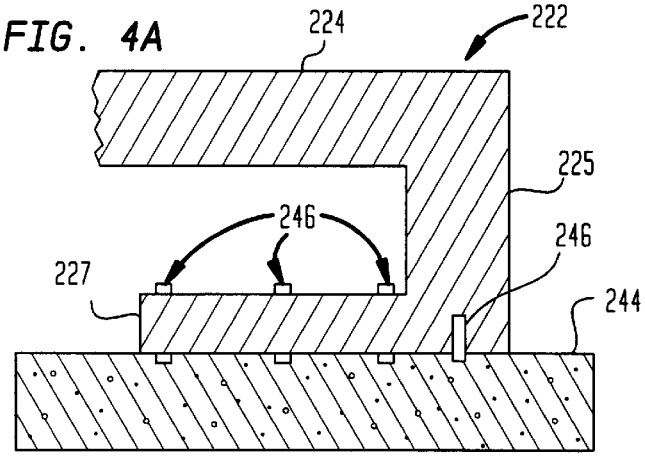
FIG. 4A is a schematic side elevation view of yet another embodiment of a cantilever beam for use in the cantilevered support of the finishing assembly of FIG. 1.
Figure 4B:
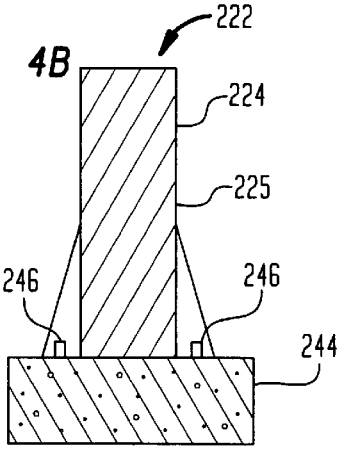
FIG. 4B is a schematic rear view of the cantilever beam of FIG. 4A.

FIGS. 4A and 4B show a typical C-frame cantilevered support 222. This type includes cantilever beam 224, vertical portion 225 and a horizontal portion 227. This cantilevered support 222 is attached to the cantilever foundation 244 in a similar manner as described above, for example, by way of concrete anchors, screws or bolts 246. In contrast to the above two types, in this cantilevered support 222, the frame portion takes the load while the cantilever foundation 244 holds the finishing assembly 20 in place.

Figure 5:
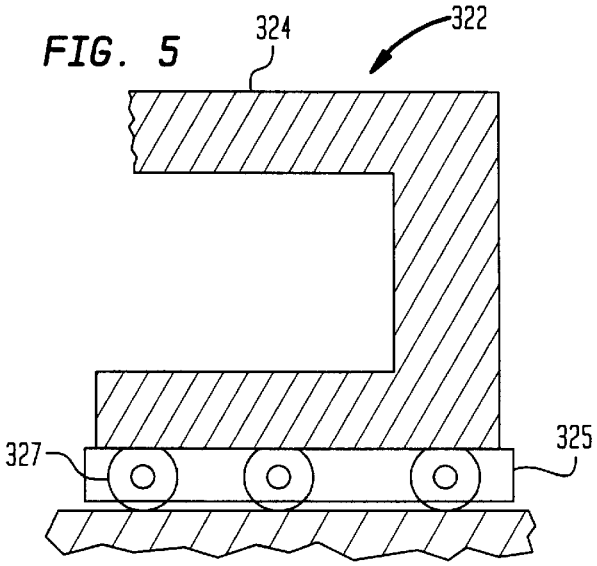
FIG. 5 is a variation of the cantilever beam as shown in FIGS. 4A and 4B, illustrating still a further embodiment of a cantilever beam which is portable.

FIG. 5 is a variation of the C-frame support 222 of FIGS. 4A and 4B. In this embodiment, the C-frame cantilevered support 322 is portable. That is, it may be placed on a cart 325, having wheels 327, so that it can be moved into and out of the finishing assembly 20 as needed. In addition, instead of lifting the non-conductive treatment assembly (discussed below) up and out of the way, the complete finishing assembly 322 can be rolled away.

As shown in FIG. 1, the pair of cantilever beams 24 and 26 are generally parallel to each other and extend in a direction transverse to the machine direction ("MD") of the finishing assembly 20. On the inside of both cantilever beams 24 and 26, there are supports 48 for supporting and detachably securing a portion of a non-contacting treatment assembly (discussed further below) to the inside of the cantilever beams 24 and 26. Attached to the outside of the first cantilever beam 24 is a roll supporting member 50 for supporting inside treatment roll 28. Attached to the outside of the second cantilever beam 26 is a releasable roll supporting member 52 for releasably supporting the inside treatment roll 30 to the cantilever beam 26 during the loading and unloading of the endless web 42. The cantilevered support 22 is necessary to allow the endless web to be loaded onto the finishing assembly 20 without interference with the various components which are secured to the pair of cantilevered beams 28 and 30. Thus, having a free end which supports the necessary treatment equipment facilitates the loading and unloading of the endless web 42 without substantial interference.

Although the above discussion discloses a cantilevered support 22 having at least two cantilever beams 24 and 26, it is to be appreciated that the present invention contemplates a cantilevered support having at least one cantilever beam. In this configuration, whatever would be supported by both cantilever beams, as discussed previously, would be thus supported by at least one of the beams instead of at least two. In addition, the cantilevered supports shown in FIGS. 2A to 5 are not drawn to scale in that the free end of the supports is relatively longer than that depicted in the Figures to accommodate the width of the rollers and non-contacting treatment assemblies which are supported therefrom.

The drop frame 34 is located below the floor 21 and is capable of being adjusted up and down by drive mechanism 35. The drop frame typically is raised out of the floor by the drive mechanism 35 after the endless web 42 has been loaded onto the finishing assembly 20. The drop frame 34 is raised so that it engages with the free end portion or portions (e.g., beams 24 and 26) of the cantilevered support 22 during treatment of the endless web. When the endless web needs to be unloaded, the drop frame 34 is retracted back into the floor 21. Thus, while the cantilever beams 24 and 26 can support the weight of a non-operational finishing assembly, when the assembly is operating, the loads are such that the beams typically should be supported by the drop frame 34. In addition to supporting the dead weight of the beams with their added loads, the drop frame 34 aids in preventing a downward deflection of the beams which may occur over their length due to the beams own weight. Thus, the drop frame 34 provides a rigid mount, that during a treatment operation, holds tolerances, for instance, to facilitate the endless web 42 to track properly and not roll off the edge of one of the rolls. Any conventional drive mechanism may be used to raise and lower the drop frame 34. By way of example, the drive mechanism may be a set of screw jacks, hydraulics or pneumatics.

The inside treatment roll 28 may be of any type which treats the endless web 42 by contact. In a preferred embodiment, inside treatment roll 28 is heated. Preferably, treatment roll 28 is heated by hot oil and is commonly referred to as an "inside hot oil roll." Alternatively, these treatment rolls may be steam heated rolls or electric heated rolls as well. Inside treatment roll 28 is spaced apart from, and arranged parallel to, inside treatment roll 30 on either side of the cantilever beams 24 and 26. In a preferred embodiment, the inside treatment roll 30 is a stretch roll which may be removably mounted on the roll supporting member 52 for movement toward and away from the cantilevered support 22. This roll also may be heated as well. The inside treatment roll 30 is moved by means of the roll carriage device 43. It should be appreciated that these components such as, for example, the inside treatment rolls 28 and 30 and the movable roll carriage device 43 are of the conventional sort used in typical finishing assemblies similar to finishing assembly 20.

The outside treatment roll 36 is vertically moveable into and out of the finishing assembly 20, preferably into the transversely-extending open space 40. The outside treatment roll 36 can be of any type which is capable of treating the endless web 42 by contact and is typically of the conventional type similar to the inside hot oil roll 28 or the inside stretch roll 30. In a preferred embodiment, the outside treatment roll 36 is heated. Most preferably, the roll 36 is heated with hot oil and is commonly referred to as an "outside hot oil roll." This roll, like the inside rolls discussed above, may be heated by steam or electric heat.

In FIG. 1, the outside treatment roll 36 is shown contacting the endless web 42 over a predetermined contact surface area. Preferably, in this embodiment, the contact surface area ranges from between about a one degree arcuate sector of the outside treatment roll to about a 340 degree arcuate sector of contact surface area of the outside treatment roll, the latter being when the outside treatment roll 36 is in its upwardmost position between the cantilever beams 24 and 26. By way of example only, the endless web 42 may typically wrap around the outside treatment roll over about a 180 degree arcuate sector.

When the outside treatment roll 36 is not in operational position, it is stored in the recessed open space 38. The outside treatment roll 36 is raised and lowered from a first position to a second position by means of a drive mechanism 54. This drive mechanism may be any of any conventional type such as a screw jack, hydraulics, and the like.

The felt guide rolls or felt follower rolls 32*a* and 32*b* are placed adjacent the outside treatment roll 36 just below the diameter of the outside treatment roll. These felt guide rolls 32*a* and 32*b* act as force actuating mechanisms. That is, when the outside treatment roll 36 is moved into operational position, it creates an upward force against the endless web 42. This force is countered and regulated by the felt guide rolls 32*a* and 32*b* to maintain the proper contact surface area of the outside treatment roll 36 on the endless web 42. Included on the felt guide rolls 32*a* and 32*b* are backup rollers 33 which are used to further counter the upward forces of the outside treatment roll and to keep the felt guide rolls 32*a* and 32*b* in a relative operating position.

Although the felt follower or guide rolls 32*a* and 32*b* and backup rollers 33 are shown positioned at or just below the diameter of the outside treatment roll 36, it is to be appreciated that the follower rolls 32*a* and 32*b* may be adjusted below the center of the outside treatment roll and toward each other following the southern hemisphere of the outside treatment roll 36 until the follower rolls 32*a* and 32*b* almost touch. Along this path, it follows that there will be a larger wrap of the endless web 42 about the outside treatment roll 36, approaching a 360 degree arcuate sector. It also should be appreciated that the guide rolls 32*a* and 32*b* also may be used to compress the endless web 42 as part of the overall treatment process.

In a first mode of operation, the finishing assembly 20 is prepared for an endless web to be loaded thereon. This is achieved by supporting the inside treatment roll 28 on roll supporting member 50 and the inside treatment roll 30 on roll supporting member 52. In addition, the drop frame 34 is lowered into the floor 21, the outside treatment roll 36 is lowered into recessed open space 38 and the roll carriage drive 43 is moved away from inside treatment roll 30. Although FIG. 1 shows inside treatment roll 28 as being rotatably fixed to supporting member 50, is should be appreciated that roll 28 may be removed after a loading of the endless web 42 in a similar fashion to the way the inside treatment roll 30 is removed.

Once the endless web 42 has been loaded onto the finishing assembly 20, the roll carriage drive 43 is moved toward the inside treatment roll 30 until it engages with the releasable roll supporting member 52. The outside treatment roll 30 is then moved from the roll supporting member 52 onto the roll carriage device 43. The carriage device 43 then moves horizontally away from the cantilevered support 22 to a predetermined distance or force depending on the type of process being performed and the size of the endless web 42. This movement of the inside treatment roll 30 effects a stretching of the endless web 42 to a certain predetermined extent which also adds to the treatment of the endless web.

Next, the outside treatment roll 36 is raised in a vertical direction such that it contacts the endless web over a predetermined contact surface area as described above. Also, the drop frame 34 is raised so that it contacts the bottoms of the free end of the cantilevered support 22. In this embodiment, the drop frame 34 contacts the cantilever beams 24 and 26 to provide support thereto.

Thus, during this particular mode of operation, the inside treatment roll 28 is heat treating the inside surface of the endless web 42 by contact, the inside treatment roll 30 is stretching the endless web 42 and the outside treatment roll 36 is heat treating the outside surface of the endless web by contact.

Figure 6:
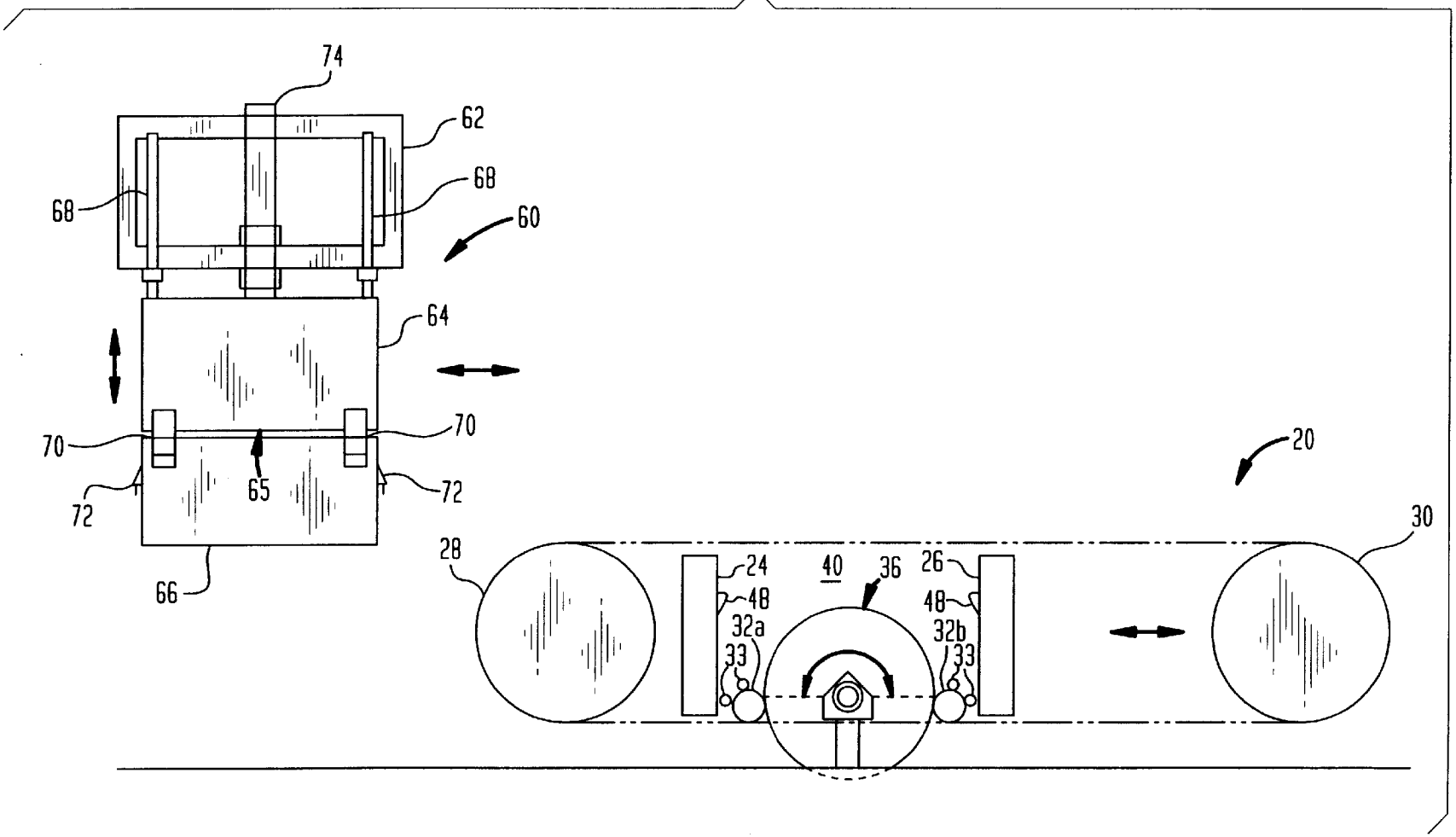
FIG. 6 is a schematic side elevation view of a finishing assembly such as shown in FIG. 1, with the addition of a non-contacting treatment assembly positioned in a non-operational or non-treatment position.
Figure 7:
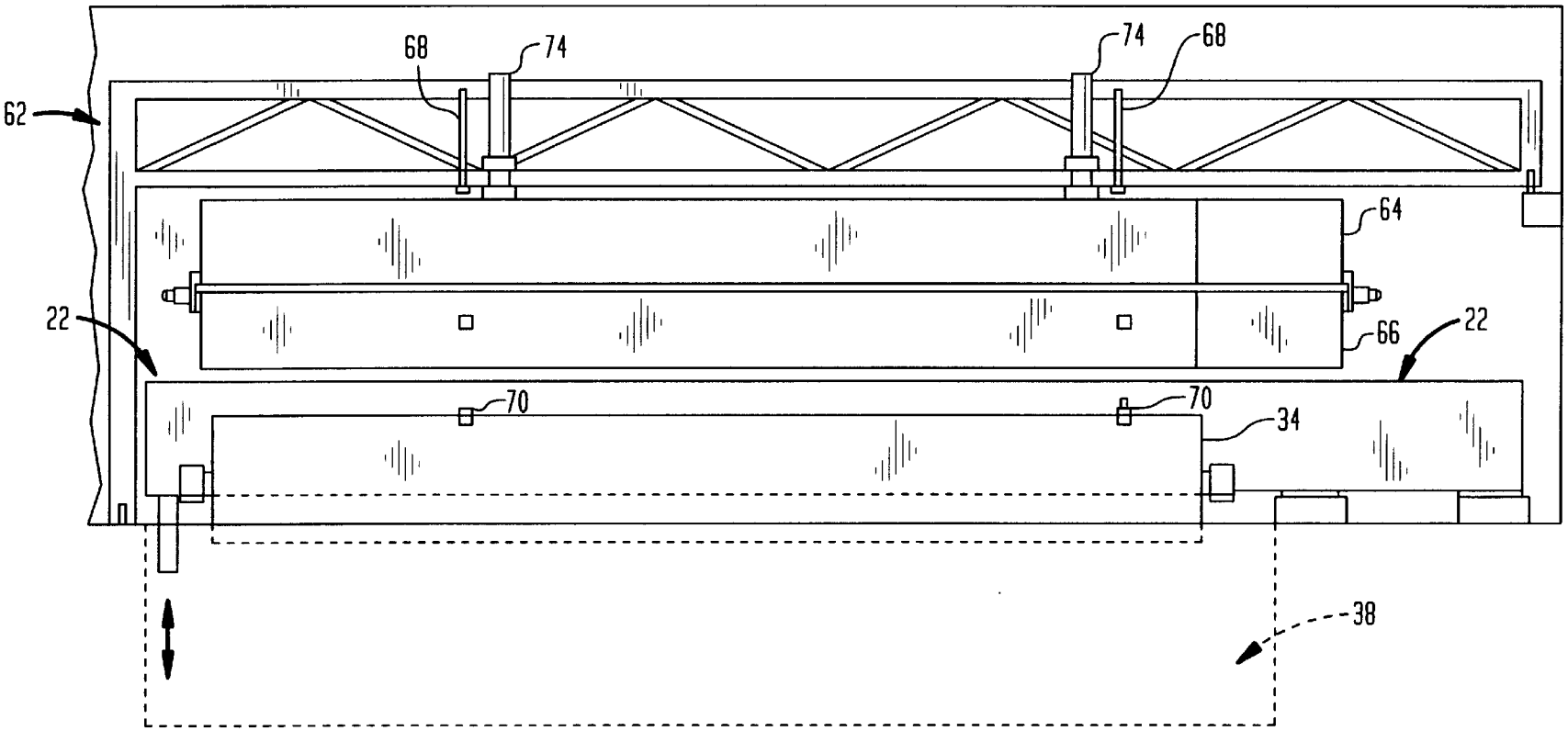
FIG. 7 is a schematic end elevation view of the finishing assembly as shown in FIG. 6.

In accordance with another aspect of the present invention, as shown in FIGS. 6 and 7, there is provided the finishing assembly 20 as shown in FIG. 1, with the addition of a non-contacting treatment assembly 60 which is shown in a non-operational or non-treatment position. Certain of the features of the finishing assembly 20 as shown in FIG. 1 are not shown in FIGS. 6 and 7 nor in the remaining Figures. However, it should be understood and appreciated that these features are included in the finishing assembly 20, but have not been shown in the remaining Figures for purposes of simplifying the drawings.

In this aspect of the present invention, the outside treatment roll 36 follows the same mode of operation as described above with respect to FIG. 1.

The non-contacting treatment assembly 60 comprises a support frame 62, a first transversely-extending housing 64 and a second transversely-extending housing 66 attached to the first housing 64. The first and second housings 64 and 66 define a horizontal gap 65 therethrough for allowing the endless web to move. The first housing 64 is attached to the support frame 62 with any mechanical or electromechanical vertical actuating mechanism. For example, the vertically adjustable securing members may be screw jacks 68. At least the first housing 64 is vertically guided by guides 74. The first housing 64 is preferably attached to the second housing 66 with securing fasteners such as docking pins 70. Also attached to the outside walls of the second housing 66 are supports 72 which correspond with supports 48 such that when the non-contacting treatment assembly 60 is in an operational or treatment position, supports 72 connect with supports 48 to secure the second housing 66 to the cantilevered support 22.

FIG. 7 illustrates the same configuration as shown in FIG. 6, but in side view. This side view reveals at least the extent of the support frame 62, first housing 64 and second housing 66. FIG. 7 also shows a portion of the cantilevered support 22.

Thus, FIGS. 6 and 7 show the finishing assembly 20 with both the outside treatment roll 36 and the non-contacting treatment assembly 60 where the outside treatment roll 36 is in operational position and the non-contacting treatment assembly 60 is positioned in a non-operational position. The operation of the finishing assembly 20 in this operation mode is similar to the operation described above except that the non-contacting treatment assembly 60 is included, albeit not in an operational position.

The first and second housings, 64 and 66, may be any type of housing which provides for treatment of the endless web 42 without contacting it. By way of example, these housings may comprise air boxes which circulate air through and around the endless web 42. The air in the air boxes may be heated. As an alternative to circulating air, the housings may provide a radiation energy source such as, for example, infrared, ultraviolet or microwave, which treat the endless web 42 without contacting it. In other embodiments, the housings may contain a chemical source, a steam heat source or a sonic energy source, such as mechanical vibrational energy or acoustic energy.

In a preferred embodiment, the non-contacting treatment assembly 60 comprises a heated air box set. For example, in a most preferred embodiment, this heated air box set may be an "Air Through Compact" heatset as manufactured by Alfsen og Gunderson AS of Norway ("AG"). The AG Air Through Compact is a double sided heatsetting system for drying fabrics, forming fabrics and press felts.

Figure 8:
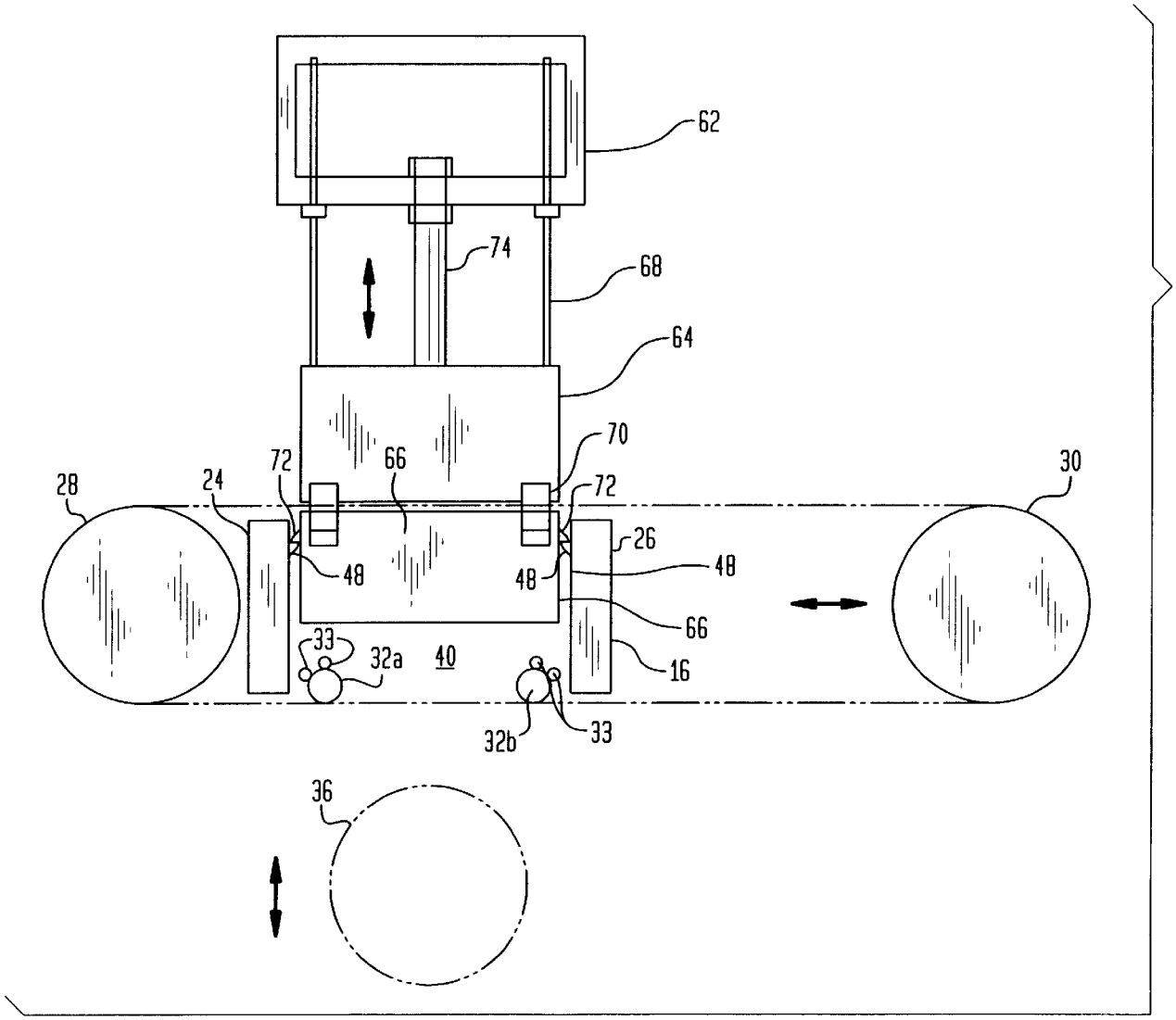
FIG. 8 is a schematic side elevation view of the finishing assembly of FIG. 6, illustrating the non-contacting treatment assembly in an operational or treatment position and the outside treatment roll in a non-operational or non-treatment position.
Figure 9:
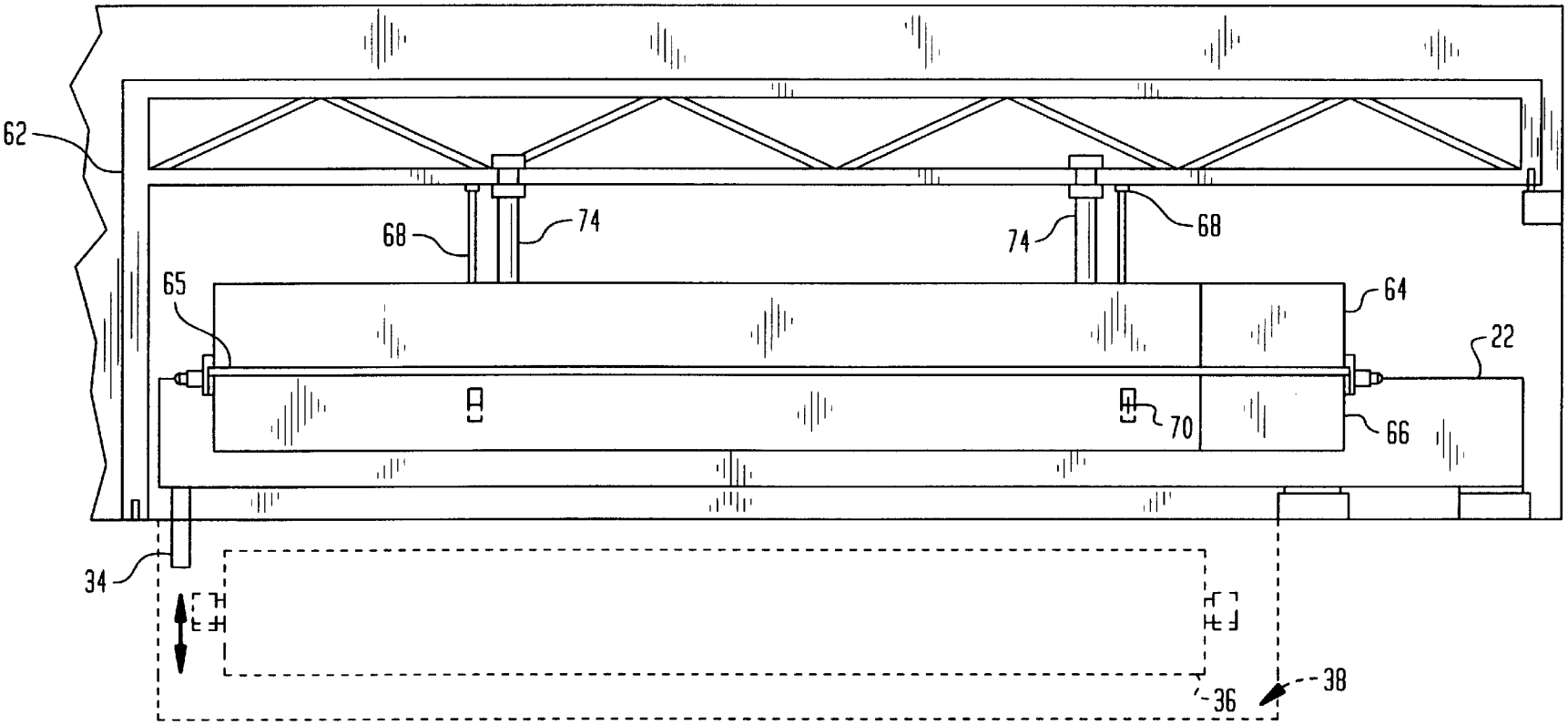
FIG. 9 is a schematic end elevation view of the finishing assembly of FIG. 8.

In another mode of operation, the non-contacting treatment assembly is moved from the position as shown in FIGS. 6 and 7 to the position as shown in FIGS. 8 and 9. In this mode of operation, the non-contacting treatment assembly 60 is set into place by the hoist mechanism as discussed above. That is, the first housing 64 is secured to the support frame 62 and the second housing 66 is secured to the first housing 64 as described above. Preferably, the assembly 60 is moved as a unit horizontally via a motorized rack and pinion drive (not shown) and vertically by the screw jacks 68 into and out of the transversely-extending open space 40, although any suitable X–Y drive mechanism would be within the scope of the present invention. Preferably, the screw jacks 68 also are motorized. Further, the outside treatment roll 36 is lowered into the recessed open space 38 in a non-operational position as discussed previously.

Once the housings 64 and 66 are moved into place, the bottom housing 66 is secured to the cantilevered support 22, preferably between cantilever beams 24 and 26. Then the top housing 64 is removed up and away to provide clearance for the loading of the endless web 42. Once the endless web is loaded, the top housing 64 is moved back into an operational position. Preferably, housing 64 is secured to housing 66 via docking pins 70.

Figure 10:
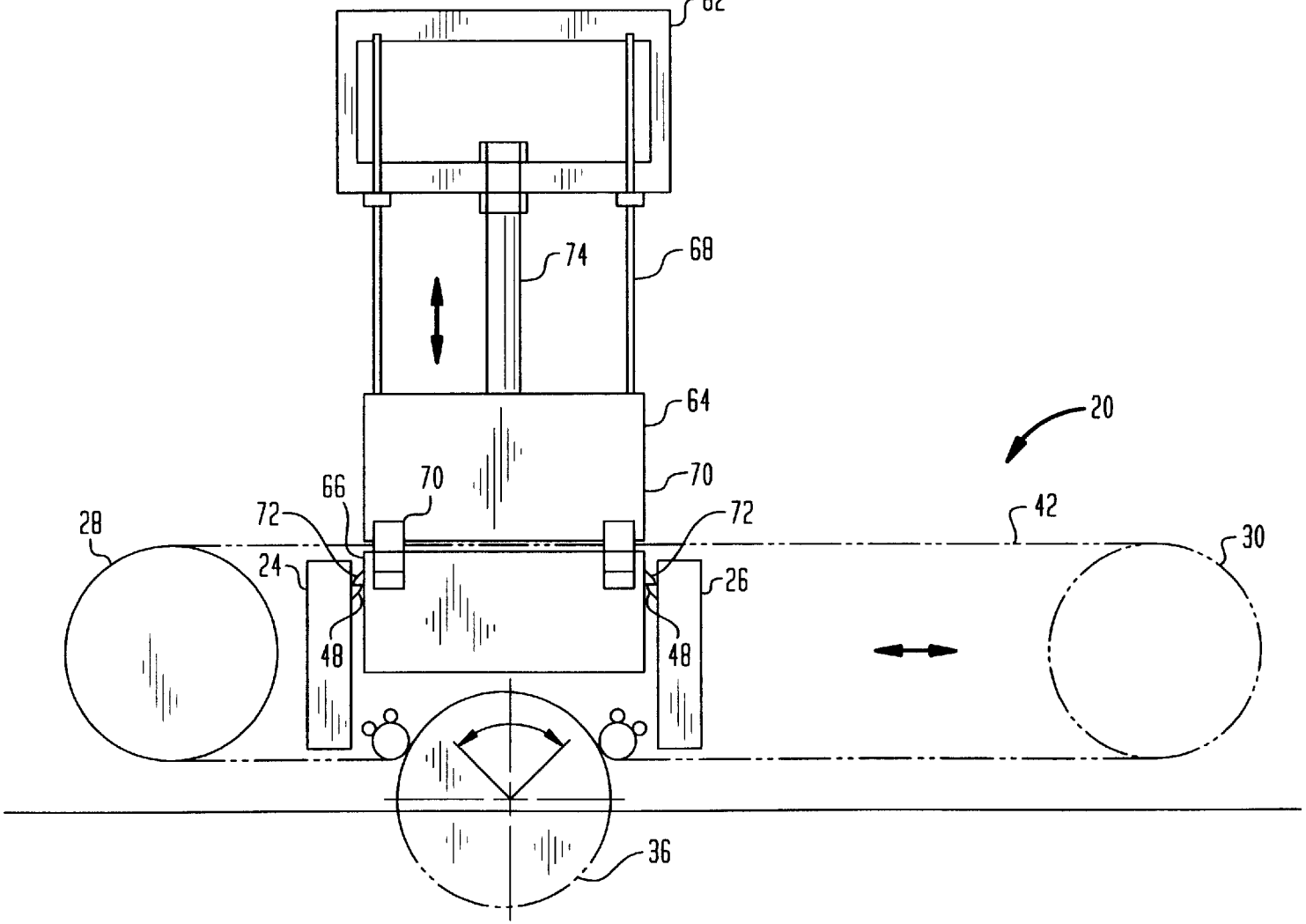
FIG. 10 is a schematic side elevation view of the finishing assembly of FIG. 6, illustrating both the outside treatment roll and the non-contacting treatment assembly in operational positions.
Figure 11:
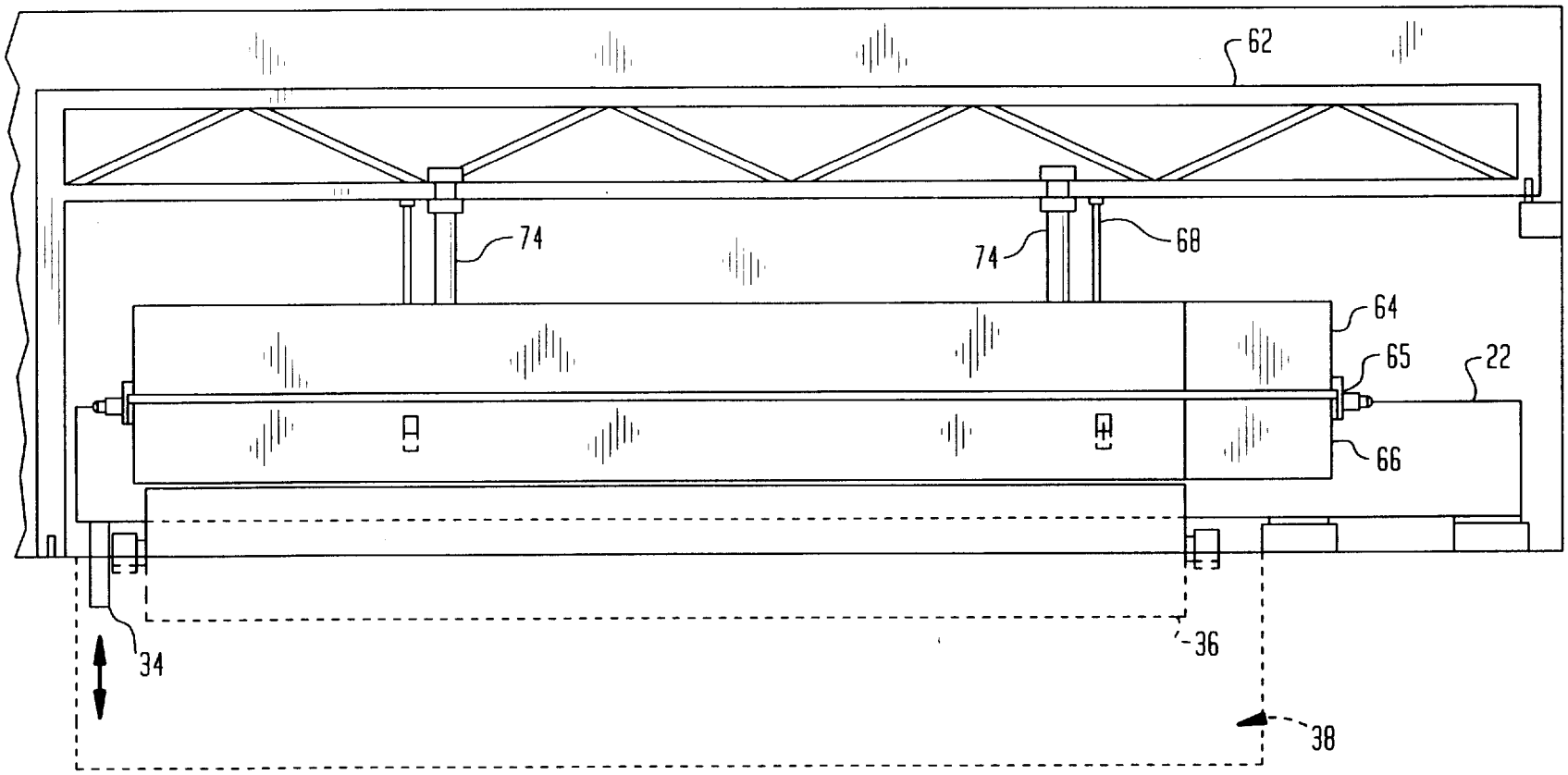
FIG. 11 is a schematic end elevation view of the finishing assembly as shown in FIG. 10.

In yet another embodiment of the present invention as shown in FIGS. 10 and 11, the finishing assembly 20 is shown where both the outside treatment roll 36 and the non-contacting treatment assembly 60 are in operational or treatment position. In this mode, the housings 34 and 36 treat the endless web 42 in combination with the outside treatment roll 36. In this configuration, the predetermined contact surface area is between about a one degree and about a 320 degree arcuate sector. By way of example, the predetermined contact surface area can be about an 80 degree arcuate sector.

Figure 12:
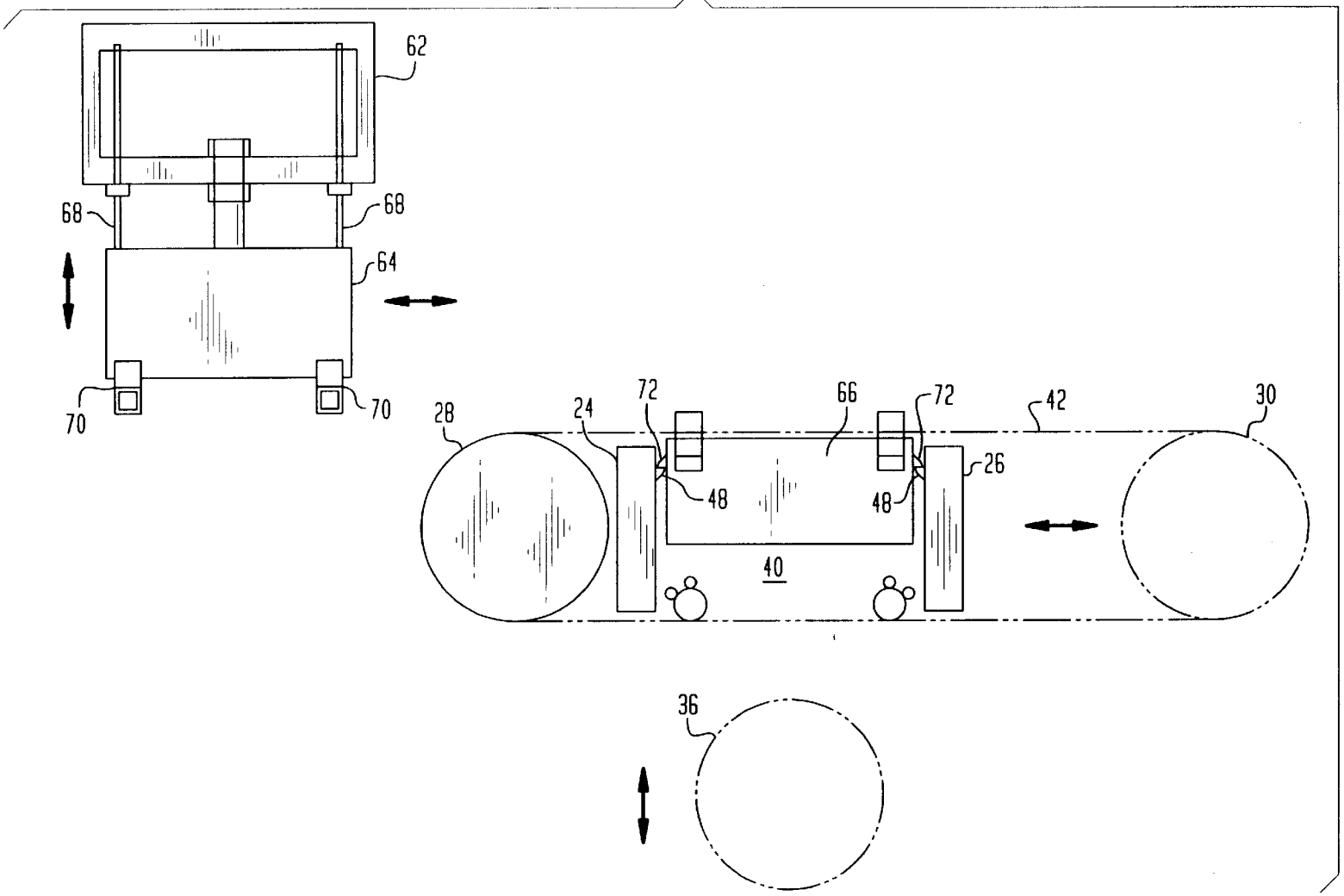
FIG. 12 is a schematic side elevation view of the finishing assembly of FIG. 6, illustrating the bottom housing of the non-contacting treatment assembly secured to the cantilevered support.
Figure 13:
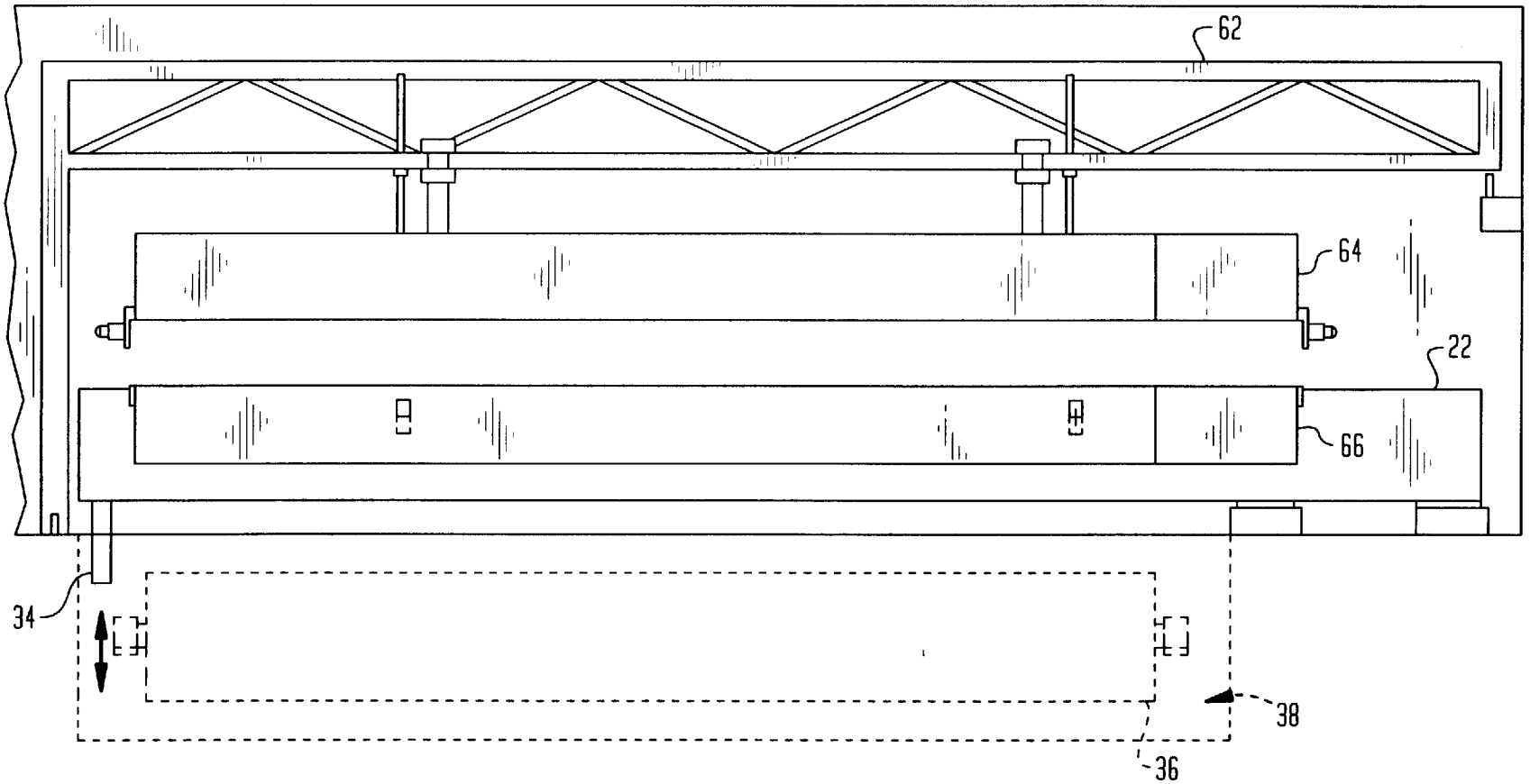
FIG. 13 is a schematic end elevation view of the finishing assembly of FIG. 12.

In another alternative embodiment as shown in FIGS. 12 and 13, the second housing 66 is secured to the cantilevered support 22 while the first housing 64 is hoisted away independently. This allows for the endless web 42 to be loaded onto the finishing assembly 20 while the second housing 66 remains between the cantilever beams 24 and 26.

Although the present invention has been described in considerable detail with reference to certain preferred embodiments thereof, other examples are possible. For example, the entire finishing assembly 20 can be inverted. That is, the outside treatment roll 36 may be positioned on the top of the finishing assembly, generally where the non-contacting treatment assembly 60 would typically be positioned. The non-contacting treatment assembly 60 will be positioned where the outside treatment roll 36 would typically be positioned. Thus, in this particular alternative, the outside treatment roll 36 is flip-flopped with the non-contacting treatment assembly 60. One advantage of this alternate embodiment is that the heating of the outside of the endless web 42 is more easily monitored and controllable. This is because, since heat rises, any residual heat which would remain on the endless web 42 when being heated from the bottom by the outside treatment roll 36, will more easily dissipate away from the endless web's surface and provide for a true measuring and controlling of the actual heat being applied to the endless web.

Thus, the present invention provides many advantages over the prior art. By way of example, one of many advantages of the present invention is that the endless web 42 may be treated both on its inside surface and its outside surface without the need for felt turning. Another advantage is that this processing is achieved while maintaining the smallest "minimum loop length" possible. This is so preferable because the outside treatment roll 36 is positioned between the cantilever beams 24 and 26. Therefore, no additional linear length is needed to make room for the outside treatment roll 36, for instance, between one of the two inside treatment rolls 28 and 30 and the outside of the respective cantilever beam 24 and/or 26.

Another example of the many advantages of the present invention is that since the non-contacting treatment assembly is movable into and out of that part of the finishing assembly 20 where the endless web 42 is treated, it facilitates different finishing processes. Having the combination of non-contacting treatment assemblies and outside treatment rolls provides for a very smooth web or felt. That is, just having ovens, for example, would leave the felt rougher than what is desired at least for the outside (i.e., paper side) surface. Adding the outside treatment roll acts like an iron, which smoothes out any remaining rough spots or imperfections in the web.

Thus, the combination of non-contacting treatment assemblies such as ovens, and outside treatment rolls provides for an ideally treated web or felt. The added advantage of this aspect of the present invention is that the combination preserves the "minimum loop length" in the process.

Finally, the present invention includes a finishing assembly which provides for increased dwell time for processing the webs without increasing the "minimum loop length." Also, if it is desirable to reduce the dwell time, one could speed up or increase the processing speed time. This results in broader ranges of processing techniques and enhanced overall manufacturing yields. In essence, the present invention provides for one assembly which is capable of performing many different processes and permeations while preserving the "minimum loop length."

While the foregoing description illustrates preferred embodiments of the various finishing assembly configurations in accordance with the present invention, it should be appreciated that the invention also covers various permutations of the foregoing described features, and that certain modifications may be made in the foregoing without departing from the spirit and scope of the present invention which is defined by the claims set forth immediately hereafter.

What is claimed is:

1. A finishing assembly for treating an endless web which extends in a machine direction when loaded onto said finishing assembly, comprising:

a. a cantilevered support having a generally horizontal free end comprising at least two cantilever beams extending in a direction generally transverse to the machine direction of said finishing assembly, said at least two cantilever beams defining a transversely-extending open space therebetween;

b. first and second inside treatment rolls for contacting the inside surface of the endless web to treat the endless web, said inside treatment rolls each being arranged to be supported on said cantilevered support when in an endless web loading position, at least one of said inside treatment rolls being movable between said loading position and an endless web treatment position, wherein said at least one of said inside treatment rolls is spaced apart from said cantilevered support in a direction generally parallel to the machine direction;

c. a movable roll carriage device for moving said at least one of said inside treatment rolls between said loading position and said treatment position; and d. an outside treatment roll for contacting the outside surface of the endless web to treat the endless web, said outside treatment roll being movable between a first position and a second position, said outside treatment roll, when in said first position, being positioned in said transversely-extending open space and operative to contact the outside surface of the endless web over a predetermined contact surface area, and, when in said second position, being positioned outside of said transversely-extending open space to allow for the endless web to be loaded onto said finishing assembly.

2. The finishing assembly of claim 1, wherein one of said inside treatment rolls is supported on one of said at least two cantilever beams and the other of said inside treatment rolls is supported on the other of said at least two cantilever beams when said inside treatment rolls are in an endless web loading position.

3. The finishing assembly of claim 1, wherein said cantilevered support comprises a generally straight horizontal free end.

4. The finishing assembly of claim 1, wherein said cantilevered support comprises an L-shaped free end.

5. The finishing assembly of claim 1, wherein said cantilevered support comprises a C-frame.

6. The finishing assembly of claim 5, wherein said cantilevered support is portable.

7. The finishing assembly of claim 1, wherein at least one of said inside treatment rolls is heated.

8. The finishing assembly of claim 1, wherein at least one of said inside treatment rolls is a stretch roll.

9. The finishing assembly of claim 1, wherein said predetermined contact surface area comprises an arcuate sector of between about one degree and about 340 degrees.

10. The finishing assembly of claim 1, wherein said outside treatment roll is heated.

11. The finishing assembly of claim 1, wherein said outside treatment roll is adapted to be retracted into a recessed open space within the floor beneath said finishing assembly.

12. The finishing assembly of claim 11, further including a drive mechanism for raising and lowering said outside treatment roll from said first position to said second position.

13. A finishing assembly for treating an endless web which extends in a machine direction when loaded onto said finishing assembly, comprising:

a. a cantilevered support having a generally horizontal free end comprising at least two cantilever beams extending in a direction generally transverse to the machine direction of said finishing assembly, said at least two cantilever beams defining a transversely-extending open space therebetween;

b. first and second inside treatment rolls for contacting the inside surface of the endless web to treat the endless web, each said inside treatment rolls each being arranged to be supported on said cantilevered support when in an endless web loading position, at least one of said inside treatment rolls being movable between said loading position and an endless web treatment position, wherein said at least one of said inside treatment rolls is spaced apart from said cantilevered support in a direction generally parallel to the machine direction;

c. a movable roll carriage device for moving said at least one of said inside treatment rolls between said loading position and said treatment position; and d. a non-contacting treatment assembly comprising a pair of transversely-extending housings, said housings defining a horizontal gap therebetween through which the endless web is movable, said non-contacting treatment assembly being movable between a treatment position and a non-treatment position, when in said treatment position, said non-contacting treatment assembly is positioned adjacent said cantilever support such that at least one of said housings is positioned in said transversely-extending open space, and when in said non-treatment position, both of said housings are positioned outside of said transversely-extending open space.

14. The finishing assembly of claim 13, wherein one of said inside treatment rolls is supported on one of said at least two cantilever beams and the other of said inside treatment rolls is supported on the other of said at least two cantilever beams when said inside treatment rolls are in an endless web loading position.

15. The finishing assembly of claim 13, wherein said cantilevered support comprises a generally straight horizontal free end.

16. The finishing assembly of claim 13, wherein said cantilevered support comprises an L-shaped free end.

17. The finishing assembly of claim 13, wherein said cantilevered support comprises a C-frame.

18. The finishing assembly of claim 17, wherein said cantilevered support is portable.

19. The finishing assembly of claim 13, wherein at least one of said inside treatment rolls is heated.

20. The finishing assembly of claim 13, wherein at least one of said inside treatment rolls is a stretch roll.

21. The finishing assembly of claim 13, wherein said housings are detachably secured to each other.

22. The finishing assembly of claim 15, wherein at least one of said housings comprises an air treatment source.

23. The finishing assembly of claim 22, wherein said air treatment source is heated air.

24. The finishing assembly of claim 22, wherein said air treatment source circulates air from said first housing, through the endless web for treatment, and to said second housing.

25. The finishing assembly of claim 13, herein said non-contacting treatment assembly further comprises an external ducting system and an internal ducting system.

26. The finishing assembly of claim 13, wherein at least one of said housings comprises an infrared energy source.

27. The finishing assembly of claim 13, wherein at least one of said housings comprises a microwave energy source.

28. The finishing assembly of claim 13, wherein at least one of said housings comprises a sonic energy source.

29. The finishing assembly of claim 13, wherein a first of said housings is supported by said cantilever support and a second of said housings is supported by said first housing.

30. The finishing assembly of claim 13, wherein said non-contacting treatment assembly further comprises a hoist mechanism for moving said housings as a unit between said treatment position and said non-treatment position.

31. A finishing assembly for treating an endless web which extends in a machine direction when loaded onto said finishing assembly, comprising:

a. a cantilevered support having a generally horizontal free end comprising at least two cantilever beams extending in a direction generally transverse to the machine direction of said finishing assembly, said at least two cantilever beams defining a transversely-extending open space therebetween;

b. first and second inside treatment rolls for contacting the inside surface of the endless web to treat the endless web, each said inside treatment rolls being arranged to be supported on said cantilevered support when in an endless web loading position, at least one of said inside treatment rolls being movable between said loading position and an endless web treatment position wherein said at least one of said inside treatment rolls is spaced apart from said cantilevered support in a direction generally parallel to the machine direction;

c. a movable roll carriage device for moving said at least one of said inside treatment rolls between said loading position and said treatment position;

d. an outside treatment roll for contacting the outside surface of the endless web to treat the endless web, said outside treatment roll being movable between a first position and a second position, said outside treatment roll when in said first position being positioned in said transversely-extending open space and operative to contact the outside surface of the endless web over a predetermined contact surface area, and when in said second position being positioned outside of said transversely-extending open space to allow for the endless web to be loaded onto said finishing assembly; and e. a non-contacting treatment assembly comprising a pair of transversely-extending housings, said housings defining a horizontal gap therebetween through which the endless web is movable, said non-contacting treatment assembly being movable between a treatment position and a non-treatment position, when in said treatment position, said non-contacting treatment assembly is positioned adjacent said cantilever support such that at least one of said housings is positioned in said transversely-extending open space, and when in said non-treatment position, both of said housings are positioned outside of said transversely-extending open space.

32. The finishing assembly of claim 31, wherein one of said inside treatment rolls is supported on one of said at least two cantilever beams and the other of said inside treatment rolls is supported on the other of said at least two cantilever beams when said inside treatment rolls are in an endless web loading position.

33. The finishing assembly of claim 31, wherein said cantilevered support comprises a generally straight horizontal free end.

34. The finishing assembly of claim 31, wherein said cantilevered support comprises an L-shaped free end.

35. The finishing assembly of claim 31, wherein said cantilevered support comprises a C-frame.

36. The finishing assembly of claim 31, wherein said cantilevered support is portable.

37. The finishing assembly of claim 31, wherein at least one of said inside treatment rolls is heated.

38. The finishing assembly of claim 31, wherein at least one of said inside treatment rolls is a stretch roll.

39. The finishing assembly of claim 31, wherein said predetermined contact surface area comprises an arcuate sector of between about one degree and about 340 degrees.

40. The finishing assembly of claim 31, wherein said predetermined contact surface area comprises an arcuate sector of between about 20 degrees and about 180 degrees.

41. The finishing assembly of claim 31, wherein said outside treatment roll is heated.

42. The finishing assembly of claim 31, wherein said outside treatment roll is adapted to be retracted into a recessed open space within the floor beneath said finishing assembly.

43. The finishing assembly of claim 42, further including a drive mechanism for raising and lowering said outside treatment roll from said first position to said second position.

44. The finishing assembly of claim 31, wherein said housings are detachably secured to each other.

45. The finishing assembly of claim 31, wherein at least one of said housings comprises an air treatment source.

46. The finishing assembly of claim 45, wherein said air treatment source is heated air.

47. The finishing assembly of claim 45, wherein said air treatment source circulates air from said first housing, through the endless web for treatment, and to said second housing.

48. The finishing assembly of claim 31, wherein said non-contacting treatment assembly further comprises an external ducting system and an internal ducting system.

49. The finishing assembly of claim 31, wherein at least one of said housings comprises an infrared energy source.

50. The finishing assembly of claim 31, wherein at least one of said housings comprises a microwave energy source.

51. The finishing assembly of claim 31, wherein at least one of said housings comprises a sonic energy source.

52. The finishing assembly of claim 31, wherein a first of said housings is supported by said cantilever support and a second of said housings is supported by said first housing.

53. The finishing assembly of claim 31, wherein said non-contacting treatment assembly further comprises a hoist mechanism for moving said housings as a unit between said treatment position to said non-treatment position.

54. The finishing assembly of claim 31, wherein at least one of said housings comprises a chemical treatment source.

55. The finishing assembly of claim 31, wherein at least one of said housings comprises a steam heat treatment source.

* * * * *